US007658302B2

(12) United States Patent
Berman

(10) Patent No.: US 7,658,302 B2
(45) Date of Patent: Feb. 9, 2010

(54) WATER GUN WITH A RETRACTABLE SPRING LOADED SHIELD

(76) Inventor: Stephen Berman, c/o JAKKS Pacific, Inc. 22619 Pacific Coast Hwy., Malibu, CA (US) 90265

( * ) Notice: Subject to any disclaimer, the term of this patent is extended or adjusted under 35 U.S.C. 154(b) by 278 days.

(21) Appl. No.: 11/224,627

(22) Filed: Sep. 12, 2005

(65) Prior Publication Data

US 2007/0056986 A1 Mar. 15, 2007

(51) Int. Cl.
*B67D 1/07* (2006.01)

(52) U.S. Cl. ..... 222/79; 222/192; 446/473; 124/66; 124/69; 124/70; 124/76

(58) Field of Classification Search ..... 222/214, 222/192, 79; 89/36.06; 446/473; 124/27, 124/65–66, 69–70, 74, 76
See application file for complete search history.

(56) References Cited

U.S. PATENT DOCUMENTS 1,020,071 A * 3/1912 Askin ..... 135/15.1
1,218,169 A * 3/1917 Chalikian ..... 446/473
1,279,930 A * 9/1918 Stroud ..... 89/36.06
2,306,708 A * 12/1942 Mendel ..... 42/106
2,941,695 A 6/1960 Rich ..... 222/132
3,038,483 A * 6/1962 Altsheler ..... 135/16
4,860,776 A * 8/1989 McQuain ..... 135/19.5
4,890,767 A 1/1990 Burlison ..... 222/78
5,065,904 A * 11/1991 McCaffrey et al. ..... 222/3
5,133,085 A 7/1992 de Pasquale Amicarelli et al. ..... 2/69.5
5,332,120 A * 7/1994 D'Andrade et al. ..... 222/78
5,411,269 A 5/1995 Thomas ..... 273/349
5,435,569 A * 7/1995 Zilliox ..... 273/349
5,611,460 A * 3/1997 Rudell ..... 222/78
5,823,849 A 10/1998 Gardner et al. ..... 446/473
D433,079 S * 10/2000 Zimmerman ..... D21/572
6,345,732 B1 * 2/2002 Zimmerman et al. ..... 222/79
D478,639 S * 8/2003 Menow et al. ..... D21/572
D479,286 S 9/2003 Menow et al. ..... D21/572
D514,173 S * 1/2006 McBride et al. ..... D21/572
7,288,102 B2 * 10/2007 Griffin et al. ..... 606/182

* cited by examiner

*Primary Examiner*—Kevin P Shaver
*Assistant Examiner*—Andrew P Bainbridge

(57) ABSTRACT

A retractable spring loaded pop-up shield for a water gun. The shield can assume one of two positions of either a folded, reclined position or of an unfolded, upright standing position.

6 Claims, 6 Drawing Sheets

WATER GUN WITH A RETRACTABLE SPRING LOADED SHIELD

BACKGROUND OF THE INVENTION

1. Field of the Invention

The present invention relates to a water gun having a shield mechanism. In particular the present invention relates to a water gun that has a retractable spring loaded shield that pops up from a separate compartment.

2. The Prior Art

U.S. Pat. No. 2,941,695, to Rich, relates to a toy umbrella that discharges water.

U.S. Pat. No. 5,611,460, to Rudell, relates to a water emitting toy shield with a water gun. The water gun is attached by the hose mechanism to the shield.

It would be preferable to have a water gun with a small retractable shield mechanism which is spring loaded and pops up at the top surface of the water gun to provide a shield for the user and which can be easily retracted and which can also be removed from the water gun if desired.

SUMMARY OF THE INVENTION

The present invention provides for a retractable spring loaded pop up shield for a water gun. It provides for a shield made preferably of PVC material which can assume one of two positions of either a folded reclined position of an unfolded upright standing position to provide a shield for the user of a water gun from being squirted by another user's water gun.

BRIEF DESCRIPTION OF THE DRAWINGS

In FIG. 7A, the shield button is pushed down and the horizontal spring pulls the lever and pops up the shield.)

DETAILED DESCRIPTION OF THE PREFERRED EMBODIMENT(S)

Figure 2:
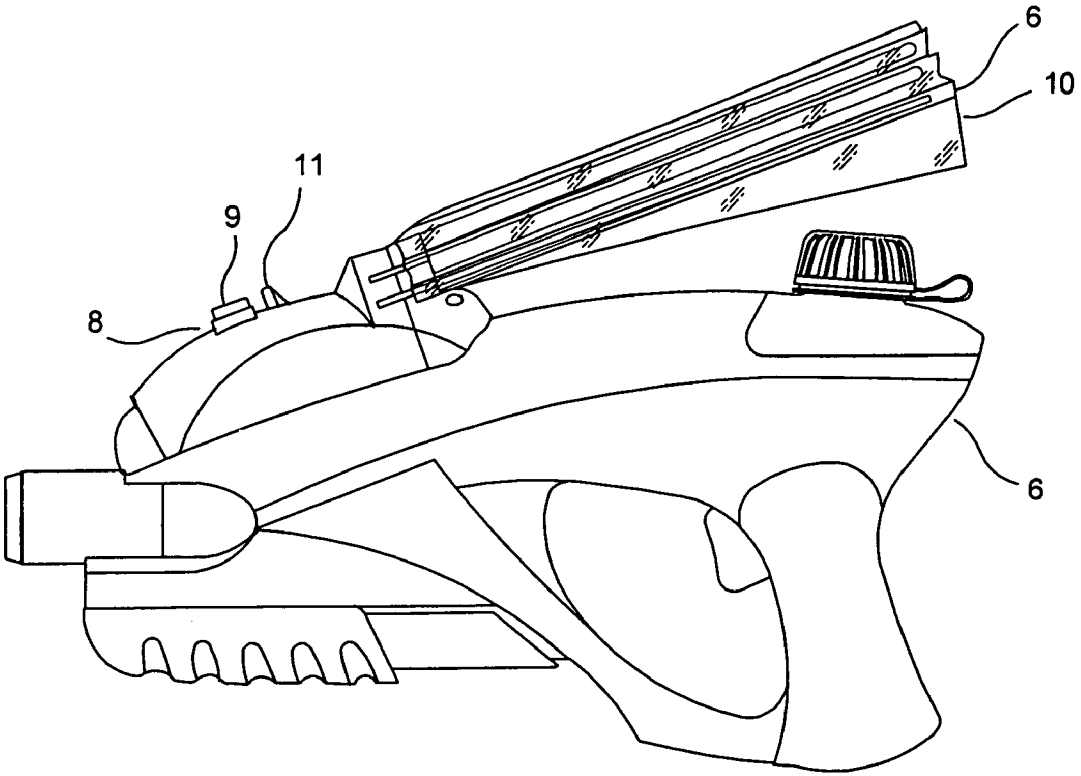
FIG. 2 is a side view of the water gun and the shield on the top surface of the gun when the shield is in its retracted, folded position.

Referring now to the drawings of FIGS. 1-7(A), FIGS. 1 and 2 illustrate the front and side views respectively of a water gun 5 with an attached shield 10. The shield 10 is shown in its folded position. The shield 10 is preferably made of PVC material. The shield has preferably six ribs 6 and six slots 7 in the housing so that each rib is inserted into a respective slot. The housing 8 is a detachable mounted housing that is removably attached to the top front portion of the water gun 5. The mounted housing 8 has preferably two plastic clips 9 that engage openings 11 in the top front portions of the water gun at both the forward and rear positions of the top portions of the water gun.

Figure 3:
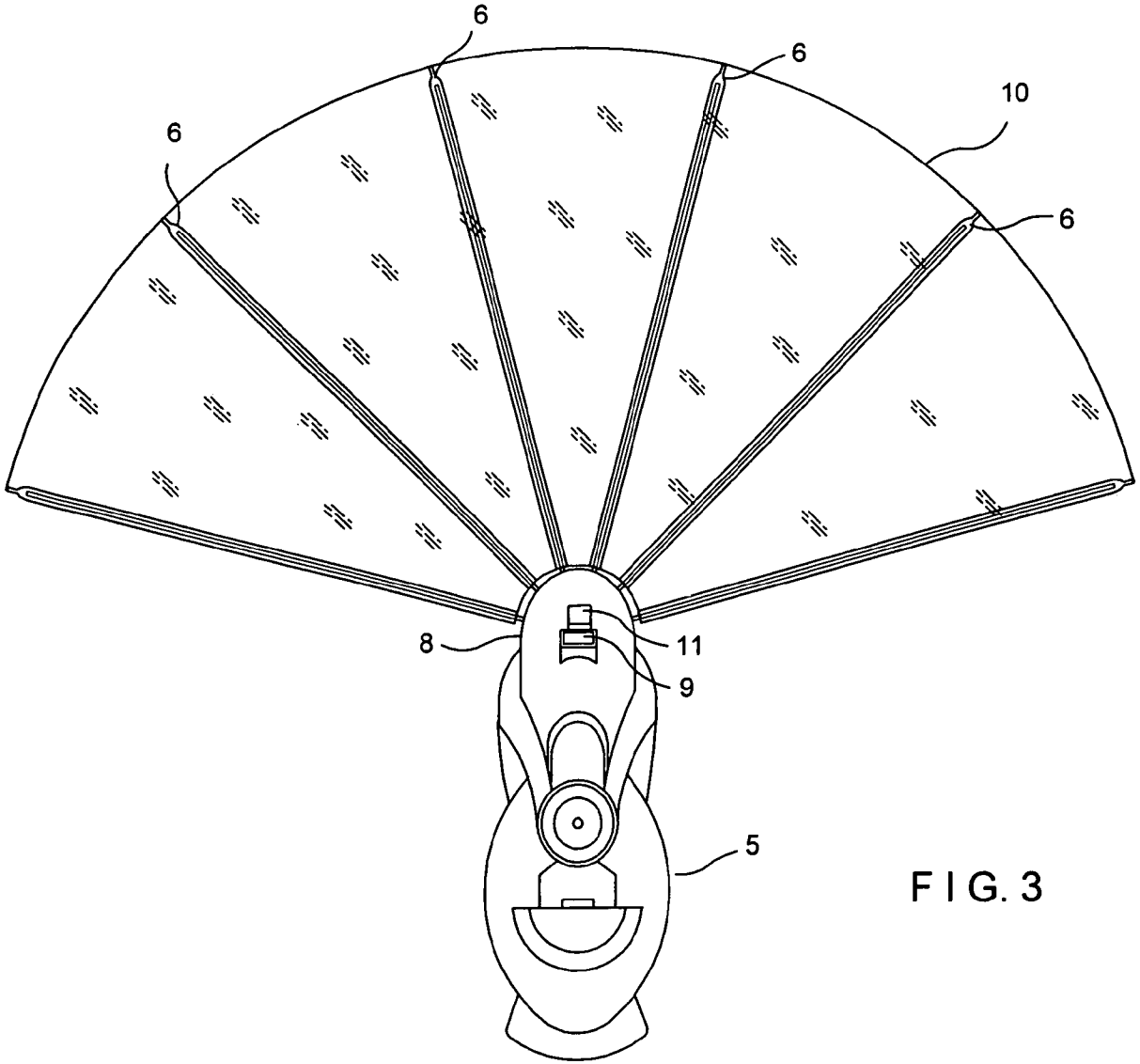
FIG. 3 is a front view of the water gun and the shield on the top surface of the gun when the shield is in its upright standing, unfolded position.
Figure 4:
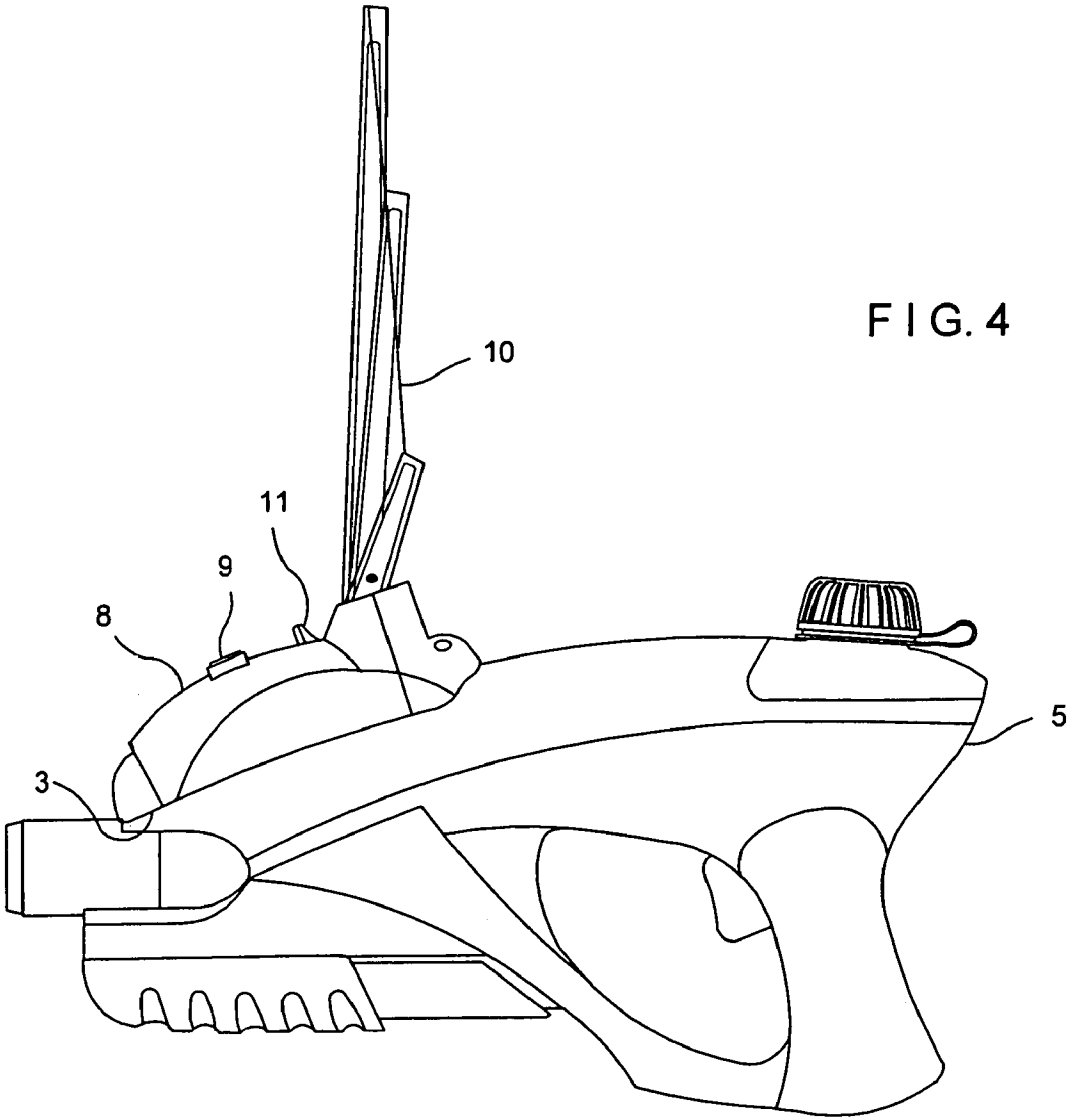
FIG. 4 is a side view of the water gun and the shield on the top surface of the gun when the shield is in its upright standing, unfolded position.

FIGS. 3 and 4 of the drawings show the shield 10 when it is activated to its fully expanded and upright position.

Figure 1:
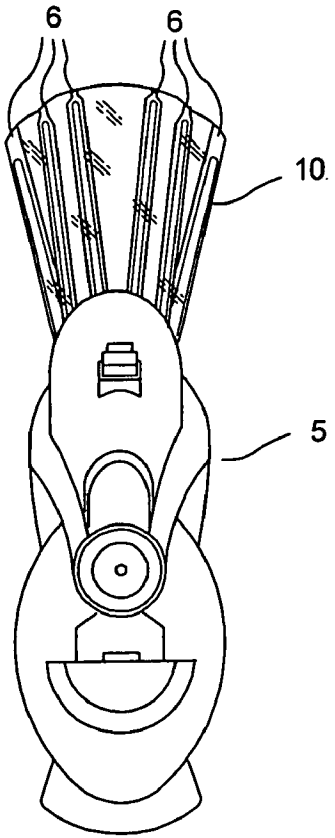
FIG. 1 is a front view of the water gun and shield on the top surface of the water gun when the shield is in its retracted folded position.

When the button 9 is pressed, the shield 10 goes from its retracted folded position to its unfolded upright position as shown in FIGS. 3 and 4. When a lever 11 is pulled forward, the shield 10 goes from its upright unfolded position to its retracted folded position as shown in FIGS. 1 and 2.

Figure 5:
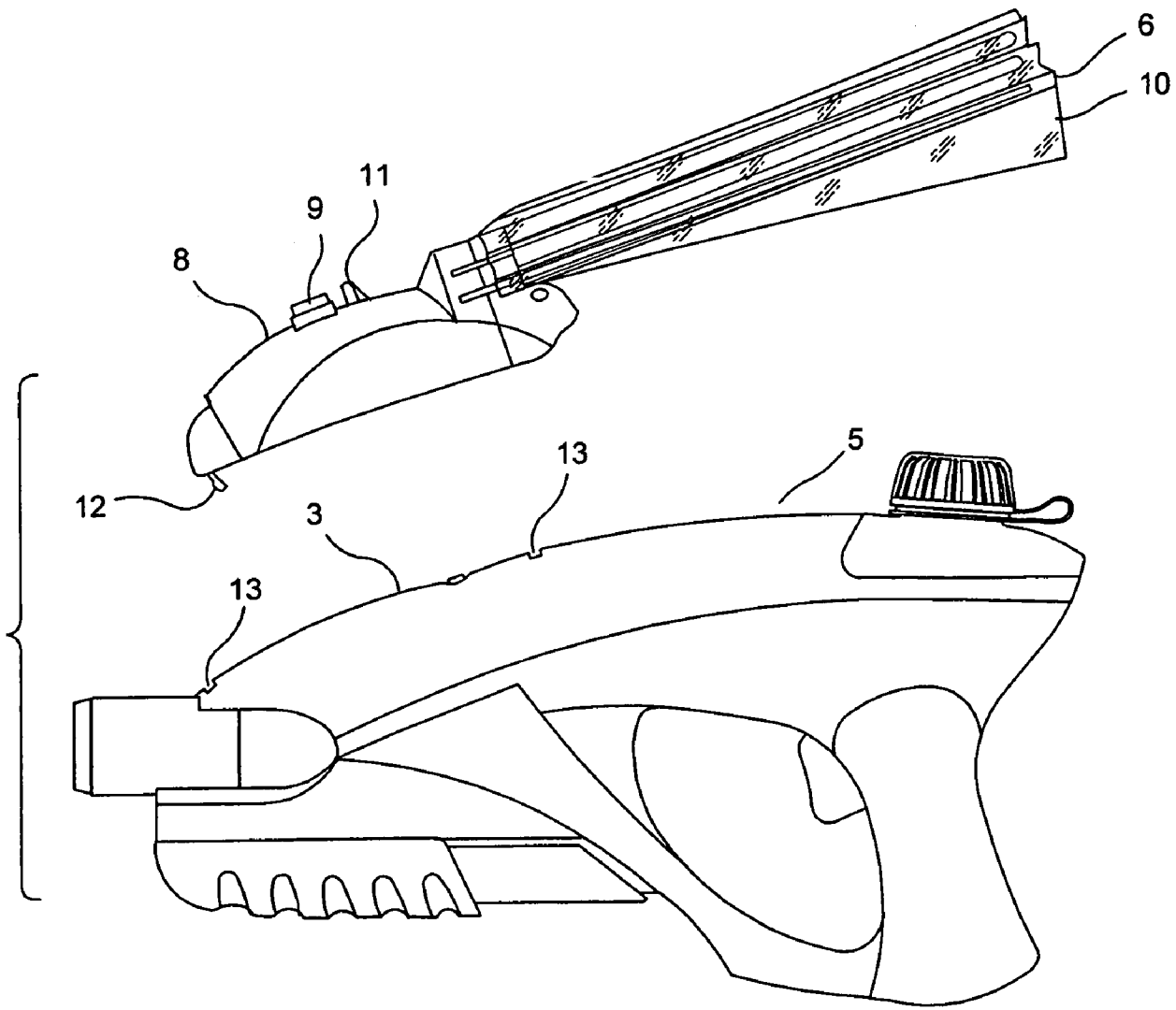
FIG. 5 is an exploded side view of the gun and shield.

FIG. 5 shows the mounted housing 8 of the attached shield 10 in a detached position from the water gun. As you can see one of the clips 12 is visible as well as the two apertures or slots 13 of the water gun 8 into which the clips 9 would securely fit to attach the mounted housing 8 to the top front surface 3 of the water gun.

Figure 6:
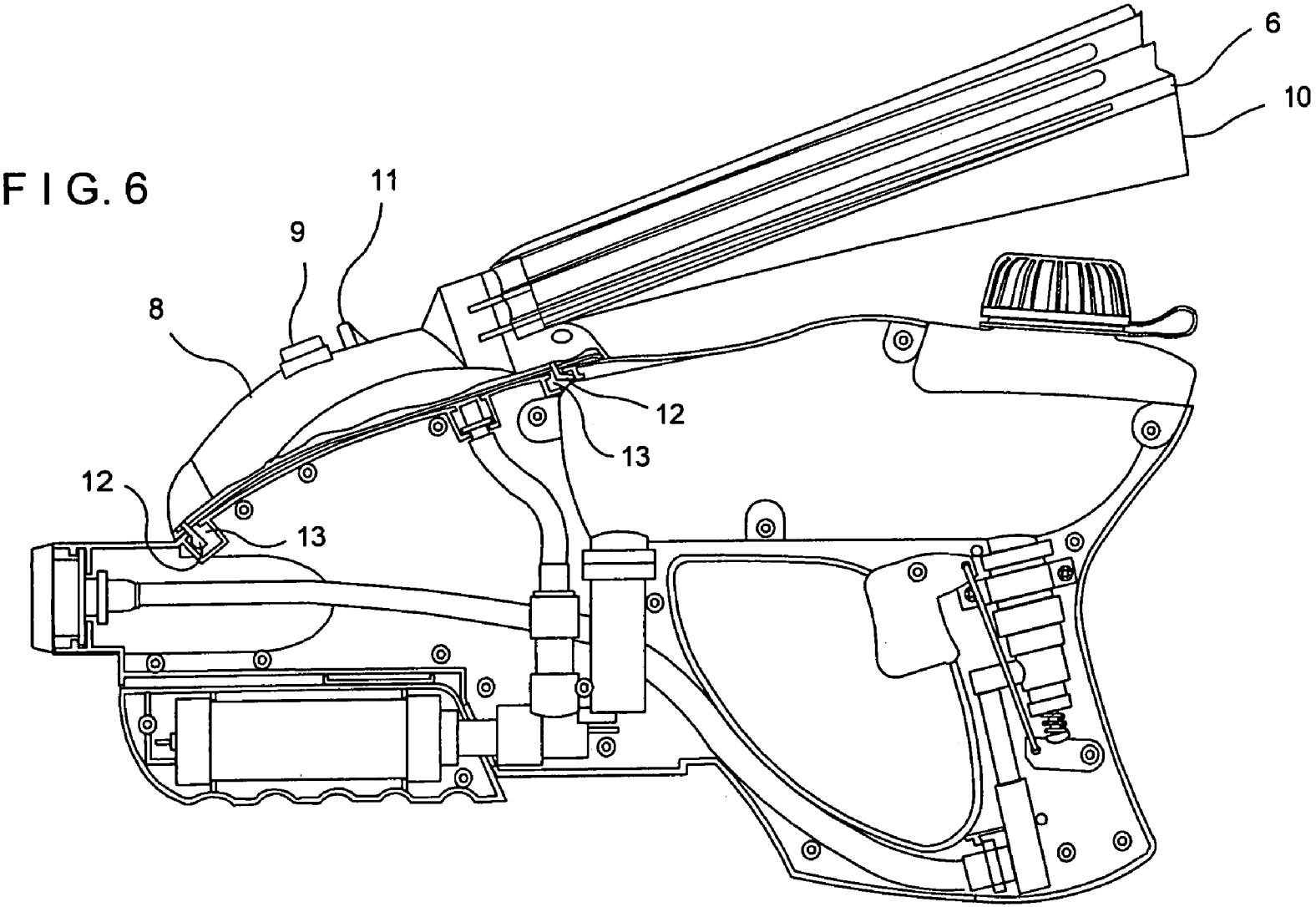
FIG. 6 is a partly cut away side view showing the connection of the shield to the gun if the closest part of the gun case is removed.

FIG. 6 shows the internal view of the water gun. The invention is not limited to any specific water gun, and any water gun can be used with a shield mechanism modified to provide for clipping the mechanism to the top front surface. The water gun view shown is the Storm water gun sold by JAKKS Pacific, Inc. which is pump activated.

Figure 7A:
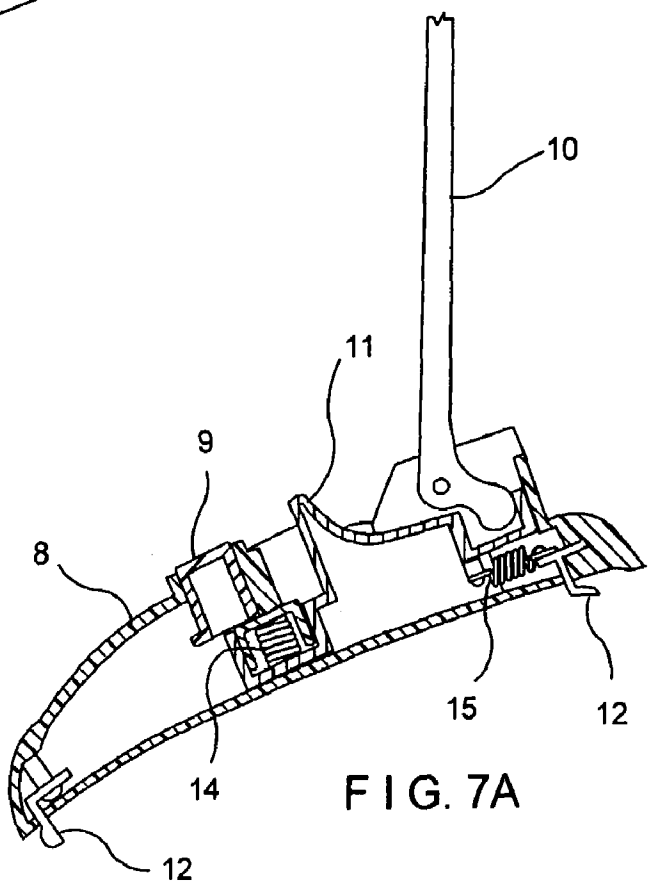
FIG. 7 and FIG. 7A show section views of two positions of the shield pop up mechanism, respectively (FIG. 7—when the lever is moved to the left which forces the shield ribs to turn in a clockwise direction and to fold the shield plastic; at the same time the vertical spring is released and pops up the shield button.
Figure 7:
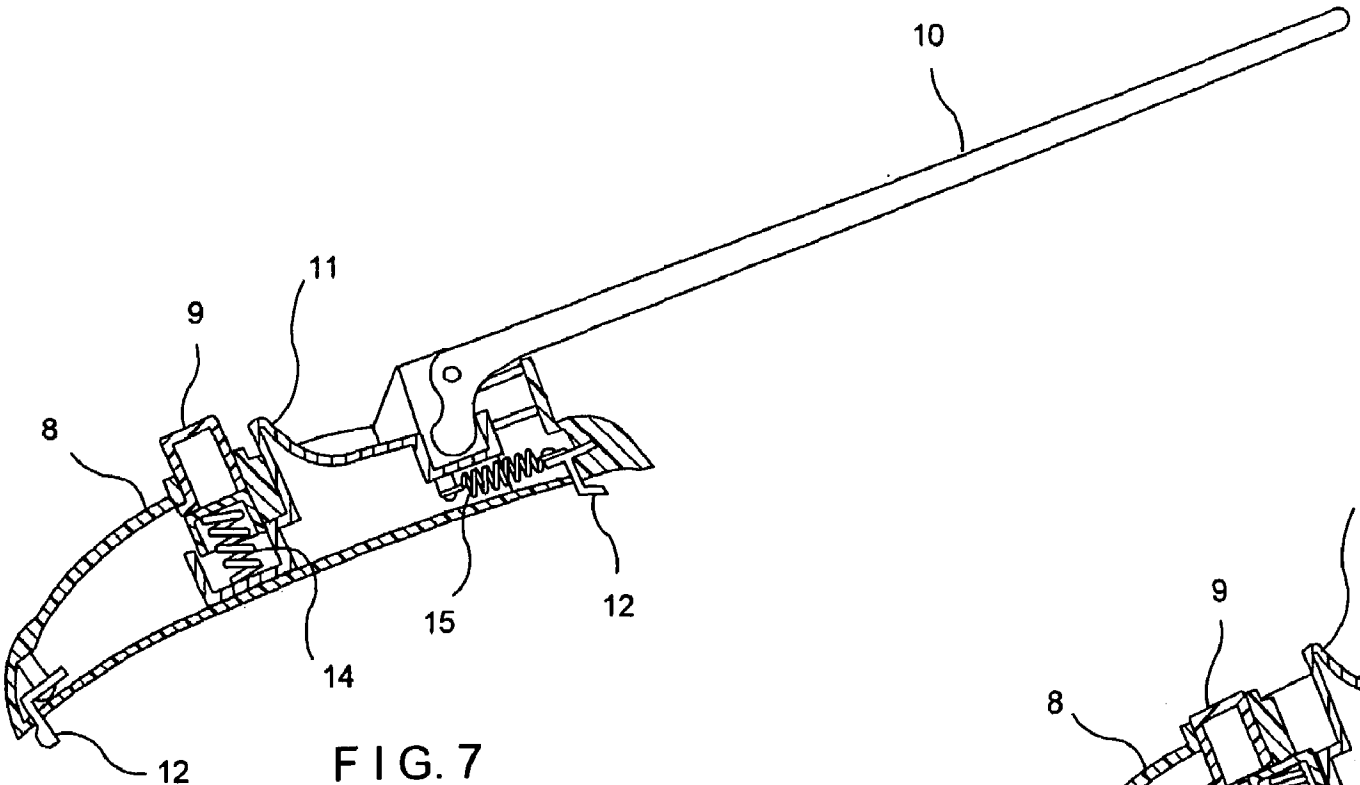

FIGS. 7 and 7A show the internal spring loaded mechanism of the shield and the mounted housing. As can be seen, the button activates a spring which releases the shield from its reclined folded position to its upright unfolded position. When the lever mechanism is pulled forward the shield is folded and reset back into its reclined position. When the lever is pulled forward, it causes the button to pull up and reset the spring mechanism so that the shield is retracted to its reclined folded position.

FIG. 7 illustrates the shield in the retracted folded position. In this position the lever is moved to the left or the forward direction of the water gun. The lever will force the ribs of the shield to turn in a clockwise direction and fold the shield while at the same time the vertical spring is released and pops up the shield button.

FIG. 7A illustrates the shield in the upright unfolded position. This position when the shield button is pushed down and the lever is pulled back retracting the horizontal spring and causes the shield to pop out into its unfolded position.

While certain preferred embodiments of the invention have been specifically illustrated and described herein, it is understood that modifications may be made therein that are within the scope of the invention. The foregoing detailed description and the accompanying drawings are therefore for illustrations only and are not intended as being limited to the spirit or scope of the appended claims.

The invention claimed is:

1. A shield for a water gun, comprising:

a water gun having a top front surface;

a shield having a plurality of ribs and a mounted housing so that said shield foldably collapses within folds of said ribs into a retracted foldable position or expendably unfold from said folds of said ribs into an upright standing, unfolded position and said shield housing has a plurality of slots, said shield housing having a button thereon and a lever; said shield housing is mounted on said top front surface of said water gun;

a spring mechanism located within said housing, said spring mechanism adopted to be activated by said button being pressed so that said shield goes from said folded retracted position to said unfolded upright standing position; and said lever being adapted to interact with said spring mechanism where said lever is slidably moved in a direction forward of said water gun so that said shield goes from said unfolded, upright standing position to said folded, reclined position.

2. The shield according to claim 1 where in said shield has six ribs and said housing has six slots.

3. The shield according to claim 1 wherein said shield is made of PVC material.

4. The shield according to claim 1 wherein said spring mechanism includes a vertical spring adapted to interact with said button and a horizontal spring adapted to interact with said lever.

5. The shield according to claim 1 further comprising said housing has two clips and said top surface of said water gun has two slots each adapted to receive a respective one of said two clips of said housing.

6. The shield according to claim 1 wherein said housing is made of plastic.

* * * * *